US005127529A

United States Patent [19]

Martinez et al.

[11] Patent Number: 5,127,529

[45] Date of Patent: Jul. 7, 1992

[54] COMPACT SHOE DRYING RACK

[76] Inventors: Florence S. Martinez; Rosendo Martinez, both of 790 Prigge Rd., St. Louis, Mo. 63138

[21] Appl. No.: 692,613

[22] Filed: Apr. 29, 1991

[51] Int. Cl.[5] ..... A47F 5/00

[52] U.S. Cl. ..... 211/37; 211/181; 248/175

[58] Field of Search ..... 211/181, 34, 37, 38; 248/175, 176

[56] References Cited

U.S. PATENT DOCUMENTS

| | | | |
|---|---|---|---|
| 1,280,445 | 10/1918 | Grace | 211/37 X |
| 1,813,573 | 7/1931 | Huestis | 211/35 |
| 2,928,549 | 3/1960 | Neuwirth | 211/34 |
| 3,608,738 | 9/1971 | Anderson | 211/38 |
| 3,693,808 | 9/1972 | Rauch | 211/181 |
| 3,730,354 | 5/1973 | Bronstein | 211/37 X |
| 4,458,585 | 7/1984 | Erbach | 211/181 X |

OTHER PUBLICATIONS

Modern Mechanix and Inventions, Nov. 1934, p. 101.

*Primary Examiner*—Robert W. Gibson, Jr.

[57] ABSTRACT

A compact shoe drying rack made of three simple parts and which is capable of being easily installed firmly between an ordinary house floor register and the floor. Simple installation requires slightly raising the register and inserting the lower legs of the rack between the floor and the register, letting the register rest upon the legs, thereby holding the rack in place during the time shoes are to be dried. It also has the capability of being easily removed from the installation without the use of tools. For easy storage and shipping it can be folded flat and slipped into an ordinary large, flat mailing envelope without the need to disassemble.

4 Claims, 5 Drawing Sheets

FIG. 2
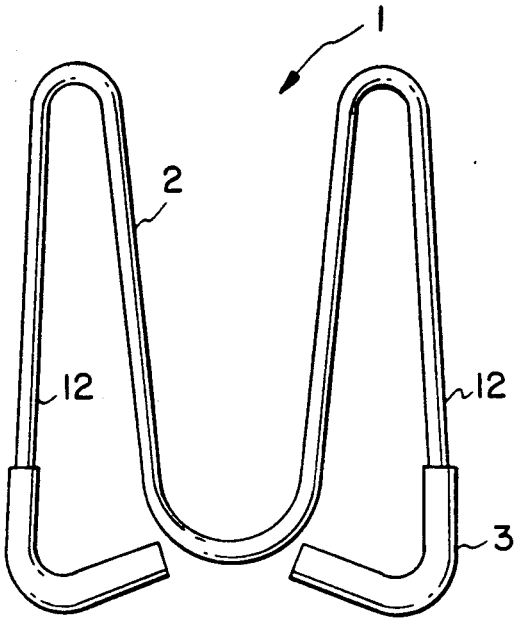
FIG. 3
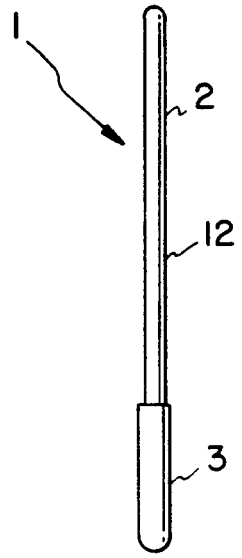
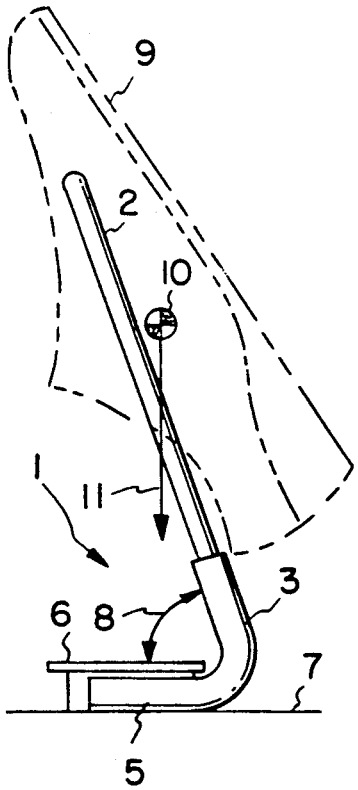
FIG. 4
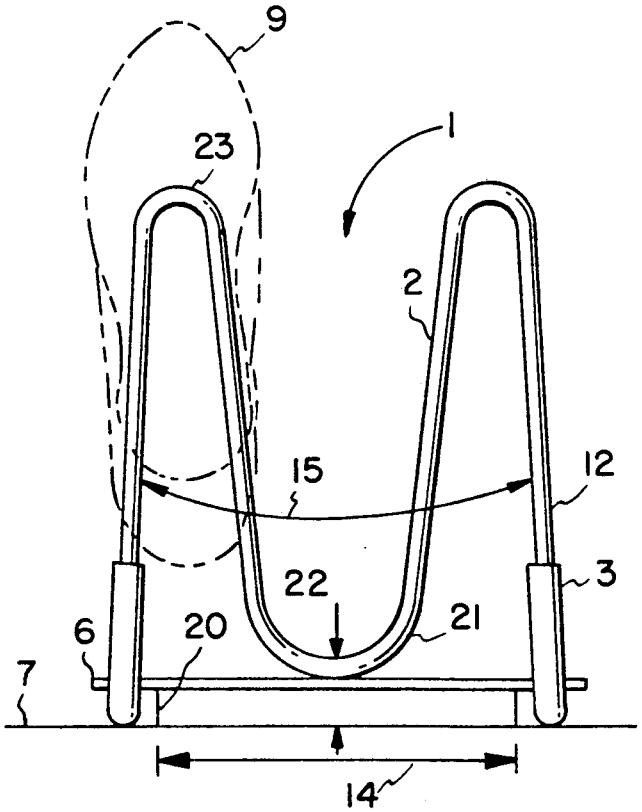
FIG. 5

COMPACT SHOE DRYING RACK

FIELD OF INVENTION

The present invention relates to a shoe drying rack, specifically the kind requiring an external drying means. Our compact shoe drying rack has the capability of being easily installed firmly between an ordinary house floor register and the floor during the time shoes are to be dried. It also has the capability of being easily removed from the installation without the use of tools and easily collapsible for storage in an ordinary large flat mailing envelope without the need for disassembling.

| REFERENCE CITED | | |
|---|---|---|
| 4,953,715 | Givliano Celli | 8/4/1989 |
| 4,823,962 | Juan G. Arias | 10/2/1987 |
| 4,727,656 | Helmot Jannach | 4/20/1987 |
| 4,596,078 | Lorne R. McCartney | 3/30/1984 |
| 4,200,993 | Roger Blanc | 7/14/1978 |
| 4,085,519 | Nicholas Masika | 8/18/1976 |
| 3,793,744 | Vasufumi Saita | 6/12/1972 |
| 2,690,571 | M. F. Gamble | 2/14/1952 |
| 2,267,634 | Albert N. Arenz | 4/16/1941 |
| 2,294,607 | Chester E. Peek | 12/5/1941 |
| 1,006,328 | Michael J. Widenhofer | 1/23/1911 |
| D 244,419 | Alwyn Anderson | 12/8/1975 |
| D 292,534 | Louis Basaraba | 2/21/1986 |
| D 293,145 | Leland G. Hughes | 7/8/1985 |
| D 208,372 | William J. Spangie | 10/20/1965 |
| D 93,021 | C. S. Jennings | 8/14/1934 |

BACKGROUND OF THE INVENTION

At the present time, there are many shoe drying techniques. For many years people have been using heat, draft air or a combination of both. Some are more complicated requiring their own heating source and their own draft air while others are more simple and require an external source of heat, air draft or a combination of both. However all of them have a major draw back. These systems require a significant volume of space for storage and shipping, or the need for disassembling if compact storage is required. It is obvious that any kind of shoe drying method that has its own heating and draft air source is best when no other external heating source or draft air is available. But if a draft air or heating source is already available in the existing home, then the self contained drying equipment is not needed, is more expensive and requires a significant amount of storage space which is a hard found luxury in most homes. This is a great inconvenience for a device that is used just a few days out of the year. Other methods that require external heating, draft air or a combination of both may or may not be as effective as the self contained methods, but they are more inexpensive than the self contained methods. Unfortunately all the present available systems require a significant amount of storage space, inconvenient assembling and disassembling for compact storage and expensive shipping containers and tariffs which are a large percentage of the customer's purchasing price.

Case in point: U.S. Pat. No. 4,727,656—Helmot Jannach's device is large and bulky. U.S. Pat. No. 4,596,078—Lorne R. McCartney's device is obviously a bulky and expensive device. U.S. Pat. No. 4,200,993—Roger Blanc's device is also bulky and expensive. U.S. Pat. No. 4,085,519—Nicholas Masika's device is very simple, but requires a significant storage space and large shipping containers. U.S. Pat. No. 3,793,744—Vasufumi Saita's device is also bulky. Other patents like U.S. Pat. No. 2,267,634—Albert N. Arenz and U.S. Pat. No. 2,294,607—Chester E. Peek, are very simple but also require a significant volume for storage and they require external hanging means if they are to be placed over a floor heater register. Other designs such as U.S. Pat. No. Des. 244,419—Alwyn Anderson, U.S. Pat. No. Des. 292,534—Louis Basaraba and U.S. Pat. No. Des. 293,145—Leland G. Hughes are all very simple devices but also require a significant volume for storage.

U.S. Pat. No. Des. 208,372—William S. Spangle's design is a simple rack attached to a floor register, obviously a permanent part of the register that requires the inconvenience of fasteners for removal and installation. Another patent, U.S. Pat. No. 4,953,715—Givliano Celli's invention is for storage of boots. It is used for drying boots but not shoes. My invention is for drying shoes, not boots. Besides, Celli's device has the inconvenience of having to be disassembled for compact storage, and reassembled when installation is needed. It also requires more parts and more complicated manufacturing than my invention.

Many other shoe racks require hanging means such as U.S. Pat. No. Des. 93,021—C. S. Jennings, U.S. Pat. No. 2,690,571—M. F. Gamble, U.S. Pat. No. 4,823,962—Juan G. Arias, etc.

U.S. Pat. No. 1,006,328—M. J. Widenhofer's invention is a cigar rack. At first glance it looks like my invention and as though it would serve the same purpose. Upon observing further, you would be able to determine that if one half of the cigar rack was used for supporting a shoe, it would not work. The shoes have to be leaning backwards to keep the device from collapsing and this of course would cause lifting of the floor register. Besides, Loop "F" would cause the register to sit too high off the floor. It is true that his invention could stand independently on the floor and support two pairs of shoes, but my device is meant to be more compact, for one pair of shoes, occupy very little floor space and capable of being stores in a large mailing envelope. His rack is more complicated and difficult to manufacture and requires more material to manufacture than my invention.

SUMMARY

It is therefore an object of the present invention to provide an inexpensive compact shoe drying rack that is convenient to store, cheap to mail and is simple to install without the use of tools.

It is made of three parts which consists of two "L" shaped members, and one "M" like shaped member. Said "L" shaped members are capable of being installed by its horizontal legs between the interface of a house floor register and the floor. Said "M" like shaped member is capable of supporting an inverted pair of shoes on the two upper loops and of being mounted to the vertical legs of said pair of "L" shaped members in a way which allows the rotation of said "L" shaped members about the vertical legs of said "M" like shaped member for the purpose of swinging said "L" shaped members inward when the rack is in storage position and to be rotated away from said "M" like shaped member when said rack is to be installed between said register and said floor for the purpose of allowing the heater's hot air draft to flow in and around said inverted pair of shoes when said pair of shoes are positioned upon the rack.

BRIEF DESCRIPTION OF THE DRAWINGS

In the drawings:

FIG. 2 is the front view of the device in FIG 1 while in the storage position.

FIG. 3 is the side view of the device in FIG. 1 while in the storage position.

FIG. 4 is a side view of the device in FIG. 1 while installed between the floor register and the floor with one shoe superimposed.

FIG. 5 is the back view of the device in FIG. 1 which is installed between the floor register and the floor with one shoe superimposed.

DETAILED DESCRIPTION OF THE INVENTION

Figure 1:
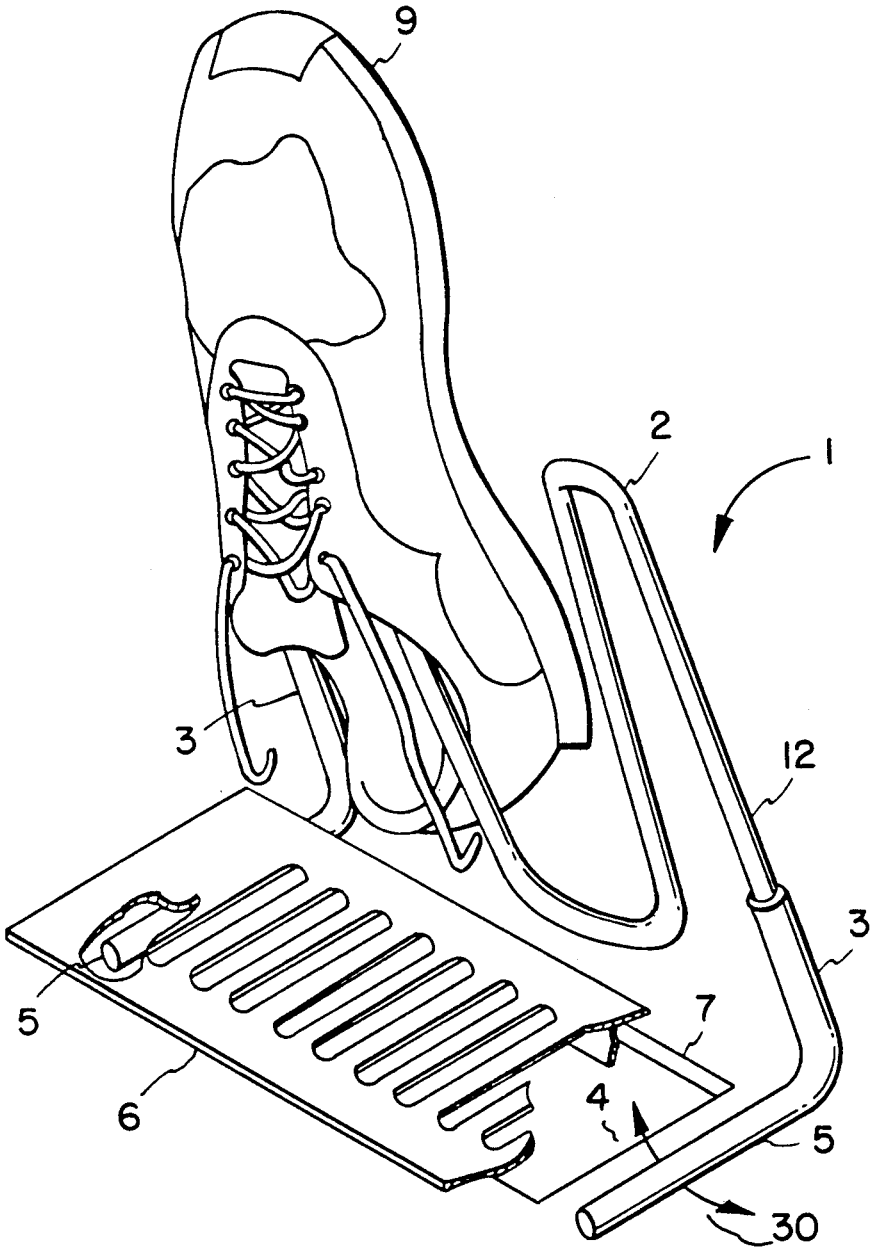
FIG. 1 is a perspective view of the compact shoe drying rack while in use.

Referring now in more detail and by reference characters to the drawings which illustrates practical embodiments of the present invention. FIG. 1 is a perspective view of the compact shoe drying rack while in use.

As shown in FIG. 1, shoe drying rack assembly 1, comprises an "M" like shaped member 2 and a pair of "L" shaped members 3. Said "L" shaped members 3 are attached and capable of rotating about the vertical legs 12 of said "M" like shaped member 2 for the purpose of swinging said "L" shaped member 3 inward 4, when said rack assembly 1 is in storage position or to be swung outward 30 when said rack assembly 1 is to be installed between floor register 6 and floor 7.

FIG. 2 and FIG. 3 are two view drawings of the device in FIG. 1 while in the storage position. As shown in FIG. 2 and FIG. 3 when both "L" shaped members 3 are rotated about the vertical legs 12 of said "M" like shaped member 2, this rotation will allow both "L" shaped members 3 and "M" like shaped member 2 to be in a single plane for easy storage and to shipped in a flat envelope. All of this is possible without assembly or disassembling of the shoe drying rack assemble 1 for convenience and without the worry of losing loose parts.

FIG. 4 and FIG. 5 are two view drawings of the device in FIG. 1 while installed between the floor register 6 and the floor 7 with a superimposed shoe 9 resting on the "M" like shaped member 2.

Shoe drying rack assembly 1 is specifically designed to allow the installation of the lower leg 5 of "L" shaped members 3 between an ordinary floor register 6 and the floor 7. "M" like shaped member 2 is capable of accepting an inverted pair of shoes 9. The center of gravity 10 of said shoes 9 is located approximately in the middle of both lower legs 5 of said "L" shaped members 3. This is accomplished by making an angle 8 of "L" shaped members 3 an acute angle. This will cause reaction 11 of shoes 9, to be located above floor register 6 in a more stable condition. Because floor registers 6 are of different sizes 14, "M" like shaped member 2 can be made of a spring like material to allow angle 15 to be increased or decreased to accommodate different sizes 14 of base 20 of floor register 6.

Although the friction at the interface between "M" like shaped member 2 and "L" shaped members 3 is sufficient to prevent the "L" shaped members 3 from swinging apart during installation, additional constraints are possible as shown in FIG. 6, FIG. 7, FIG. 8, FIG. 10 and FIG. 11.

Figure 6:
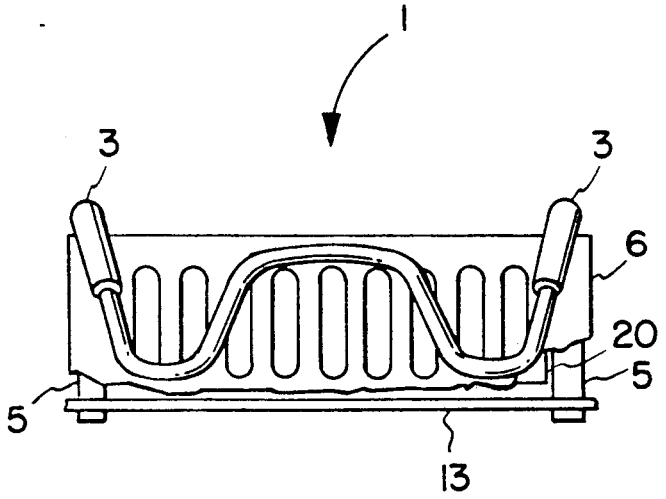
FIG. 6 is the top view of an alternative embodiment of the device in FIG. 1.

As shown in FIG. 6, this view of the device in FIG. 1 can also incorporate a resilient member 13 attached to both "L" shaped members 3 at the end of lower leg 5. Said member 13 is added to keep lower legs 5 of "L" shaped members 3 in contact with base 20 of floor register 6 for the purpose of maintaining the stability of the shoe drying rack assembly 1.

Figure 7:
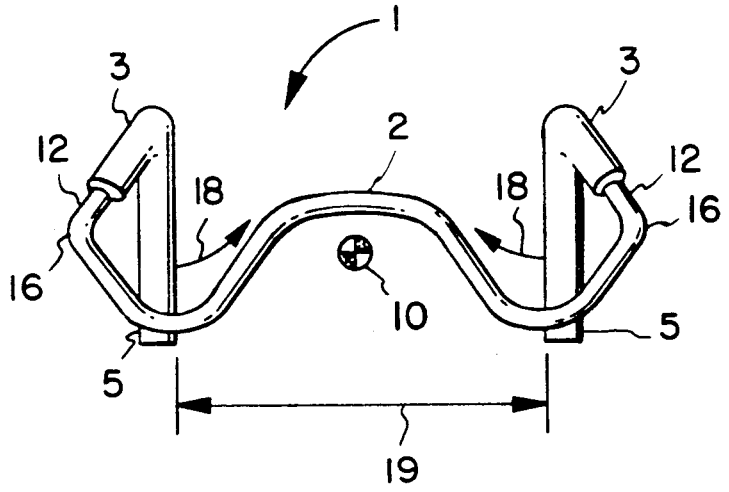
FIG. 7 and FIG. 8 are two view drawings of the device in FIG. 1 with another alternative embodiment.
Figure 8:
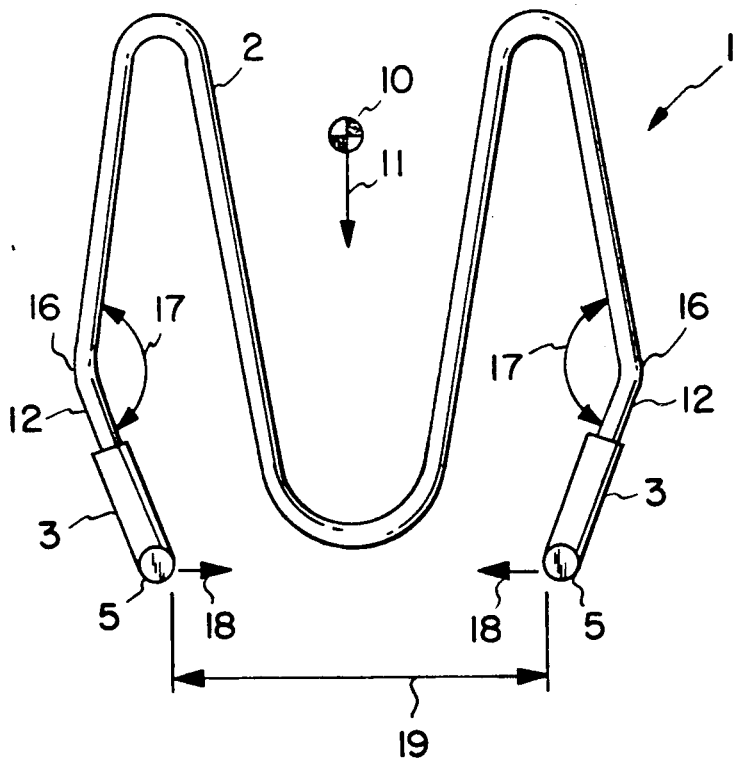
Figure 11:
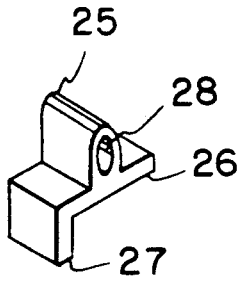
FIG. 10 and FIG. 11 are alternative embodiments of the device in FIG. 1.

As shown in the two view drawing of FIG. 7 and FIG. 8, the device in FIG. 1 can also incorporate a bend 16 of angle 17 of lower leg 12 of "M" like shaped member 2. This bend 16 will cause the lower leg 5 of "L" shaped members 3 to swing inward 18 when the center of gravity 10 of both shoes' applied reaction 11 to rack assembly 1. Of course this can only work when distance 19 of shoe rack 1 is the same or greater than distance 14 of base 20 of floor register 6 shown in FIG. 5. This configuration will not require resilient member 13 shown in FIG. 6, but it will require different size 19 for different size 14 of base 20 of floor register 6.

Figure 10:
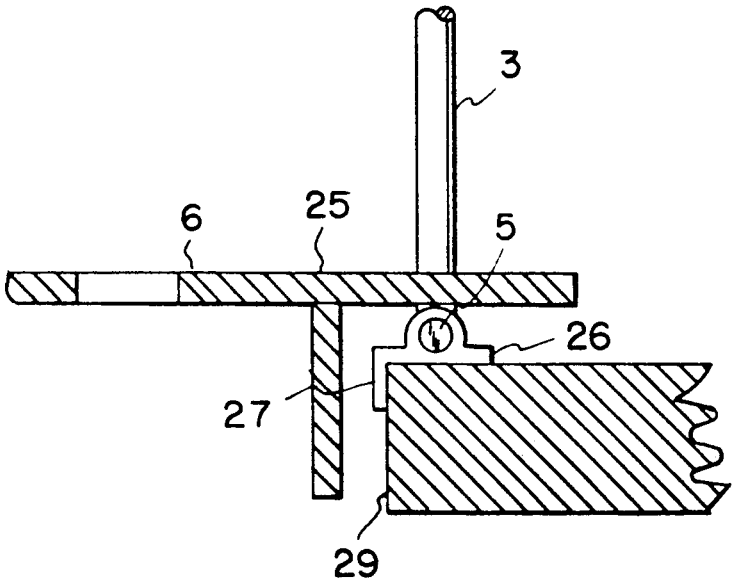

As shown in FIG. 10, this cut view of the device in FIG. 1 presents another alternative embodiment. As shown in FIG. 10, the device in FIG. 1 can also incorporate a hinge like clip 25. Said clip 25 has a hole 28 which is capable of spinning around the lower leg 5 of each "L" shaped members 3. Said hinge like clip 25 also incorporates a vertical leg 27 which will prevent both "L" shaped members 3 from spreading apart when next to floor opening 29. Said hinge like clip 25 also incorporates a horizontal extension web 26. Said extension web 26 will prevent hinge like clip 25 from spinning around lower leg 5 during installation.

As shown in FIG. 5, for safety reasons, it is best when the lower loop 21 of "M" like shaped member 2 has a large enough radius to prevent the choking of a small child if the child should fall landing with his neck in the loop 21. Also, distance 22 from the floor to the top of loop 21 is short enough to prevent a small child from hanging himself and upper loop 23 to be large enough to prevent entrance into the mouth of a small child should he fall on it in this manner.

Figure 9:
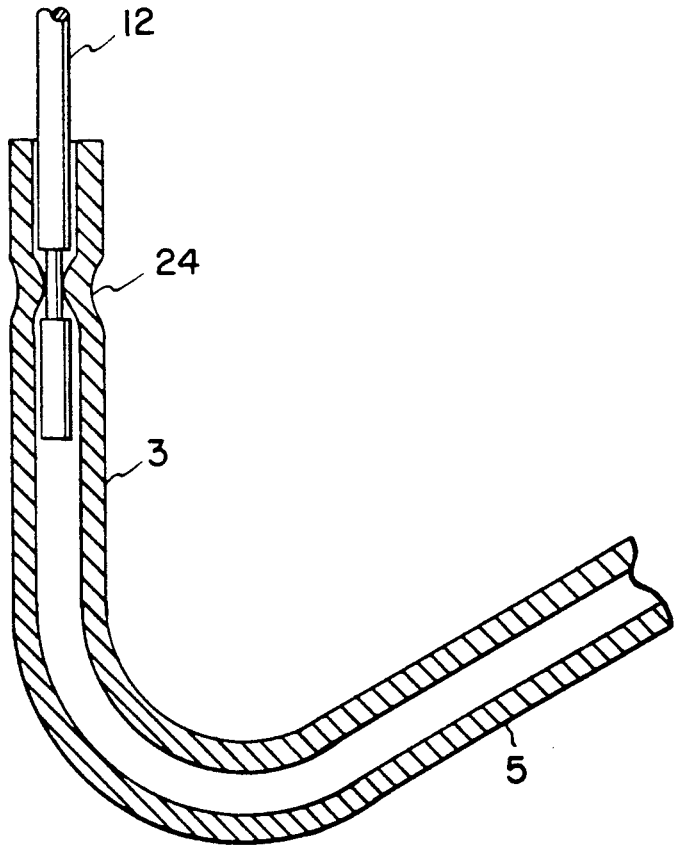
FIG. 9 is a cut view of one of the many methods of joining "L" shaped members to the "M" like shaped member.

This invention has been thoroughly tested and found to be completely satisfactory for the accomplishment of the above objects. While I have shown in preferred embodiment thereof, I wish it to be specifically understood that the same may be modified. For example, "M" like shaped member 2 can be a solid rod and "L" shaped members 3 can be a tube. It is also possible for "M" like shaped member 2 to be a tube and for "L" shaped member 3 to be a solid rod. It is possible to have "M" like shaped member 2 and "L" shaped members 3 made of different diameter tubes. "M" like shaped member 2 and both "L" shaped members 3 can be held in place by gravity although this is not recommended because of having 3 loose parts. It is possible to thread "M" like shaped member 2 to "L" shaped members 3 to keep them in place and of course many other methods of attachments are also possible like pins in slotted holes, swage 24 as shown in FIG. 9, etc.

It is also understood that a ninety degree angle or larger of "L" shaped members 3 can work if the center of gravity of the shoe stays above register 6, but is not recommended.

Let it also be understood that this device can be made of many different materials. Lower loop 21 and loop 23 can be of many shapes as well, such as rectangular, parabolic, etc.

It is also possible to have any shape of the cross sections of the "M" like shaped member and the "L" shaped members if the joint between both members is circular with the spinning capability.

Having thus described my invention, what I claim is new and desire to secure by U.S. Letters Patent is:

1. A compact shoe drying rack comprising of:

a pair of "L" shaped members capable of being installed by the horizontal legs between the interface of a house floor register and the floor opening;

an "M" like shaped member capable of supporting an inverted pair of shoes on the upper points and mounted to the vertical legs of said pair of "L" shaped members in a way of allowing the rotation of said "L" shaped members about the vertical legs of said "M" like shaped member for the purpose of swinging said "L" shaped members inward when the rack is in storage position and to be rotated away from said "M" like shaped member when said rack is to be installed between said register and said floor for the purpose of allowing the heater's hot air draft to flow in and around said inverted pair of shoes when said pair of shoes are placed upon the rack.

2. The rack of claim 1 wherein a resilient member is attached to the horizontal legs of both "L" shaped members and the "M" like shaped member is made of spring material to allow the lower legs of said "M" like shaped member to spring inward and outward for the purpose of maintaining said horizontal legs of "L" shaped members in contact with the base of the floor register to hold the shoe rack in place.

3. The rack of claim 1 wherein both lower legs of said "M" like shaped member have an inward bend for the purpose of causing the lower legs of "L" shaped members to swing inward when the load of the shoe weight acts upon the rack.

4. The rack of claim 1 wherein a hinge like clip with a hole that is capable of spinning around the lower horizontal leg of each "L" shaped member and incorporating a vertical leg which will prevent both "L" shaped members from spreading apart when next to the floor opening and an extension horizontal web that will prevent said hinge like clip from spinning around said horizontal leg of the "L" shaped member during installation.

* * * * *